US006640579B2

(12) United States Patent
Matsushima et al.

(10) Patent No.: US 6,640,579 B2
(45) Date of Patent: Nov. 4, 2003

(54) LAMINATED HEAT EXCHANGER AND REFRIGERATION CYCLE

(75) Inventors: Hitoshi Matsushima, Ryugasaki (JP); Mari Uchida, Tsuchiura (JP); Mitsugu Aoyama, Shimizu (JP)

(73) Assignee: Hitachi, Ltd. for the Benefit of Hitachi Air Conditioning Systems Co. Ltd., Tokyo (JP)

( * ) Notice: Subject to any disclaimer, the term of this patent is extended or adjusted under 35 U.S.C. 154(b) by 0 days.

(21) Appl. No.: 10/216,723

(22) Filed: Aug. 13, 2002

(65) Prior Publication Data

US 2003/0051501 A1 Mar. 20, 2003

(30) Foreign Application Priority Data

Sep. 18, 2001 (JP) ..... 2001-282569

(51) Int. Cl.[7] ..... F25D 17/02; F28D 7/10

(52) U.S. Cl. ..... 62/435; 165/157

(58) Field of Search ..... 62/435, 513; 165/157, 165/163, 170, 173, 153

(56) References Cited

U.S. PATENT DOCUMENTS 4,883,117 A * 11/1989 Dobbs et al. ..... 165/164

FOREIGN PATENT DOCUMENTS

JP A-2000-292079 10/2000
JP A-2001-50611 2/2001

* cited by examiner

*Primary Examiner*—Chen Wen Jiang
(74) *Attorney, Agent, or Firm*—Antonelli, Terry, Stout & Kraus, LLP

(57) ABSTRACT

A laminated heat exchanger includes a plurality of laminated plates, in which a plurality of heat transfer tubes bent into a zigzag form are arranged in contact with each surface of each of the plates, and the plates are laminated so that the heat transfer tubes on one of adjacent plates intersect with the heat transfer tubes on the other of the adjacent plates.

16 Claims, 12 Drawing Sheets

LAMINATED HEAT EXCHANGER AND REFRIGERATION CYCLE

BACKGROUND OF THE INVENTION

The present invention relates to a laminated heat exchanger and a refrigeration cycle. More particularly, it relates to a plate-type laminated heat exchanger used for an evaporator or a condenser forming a refrigeration cycle, and a refrigeration cycle itself.

Generally, in a plate-type heat exchanger, flow paths are formed between a plurality of laminated plates, and fluids having a different temperature are caused to flow alternately in these flow paths, by which heat exchange is effected. Therefore, the heat exchanger of this type offers an advantage that the size thereof can be decreased to a large extent as compared with the conventional heat exchanger such as a shell-and-tube heat exchanger.

A herringbone type plate for the plate-type heat exchanger has a herringbone wavelike heat transfer surface disposed slantwise downward from a longitudinal centerline of the plate toward both directions, and is manufactured usually by pressing a thin metal sheet such as a stainless steel sheet. These plates are laminated by being vertically reversed alternately, by which the plate-type heat exchanger is formed.

When the plate-type heat exchanger is used as an evaporator or a condenser for a refrigeration cycle, a high-pressure refrigerant and low-pressure water flow alternately in the flow paths formed by the plates. In the plate-type heat exchanger of a herringbone type, the pressure resisting strength is improved by contact between peaks of the wavelike heat transfer surfaces. However, it is difficult to completely prevent leakage of the refrigerant. Also, it is indispensable to use a highly rigid metal such as stainless steel as a material for the plate, which imposes a restriction on fabrication. Further, in order to prevent leakage of the refrigerant, the whole of the laminated plates are fixed usually by brazing. The brazing of the plates requires highly sophisticated production technology and equipment, which results in a higher cost.

Further, the upper limit value of working pressure is kept at about 3.1 MPa because of the pressure resistance, it is difficult to use the heat exchanger of this type for a refrigeration cycle using a high-pressure refrigerant such as R410A and carbon dioxide. Since the plate is manufactured by pressing a thin metal sheet, a ratio of molds to initial cost is high, so that it is difficult, in terms of cost, to freely set pattern and dimensions of heat transfer surface so as to meet specification of heat exchanger needed for the refrigeration cycle.

Conventionally, a plate-type heat exchanger constructed by laminating a plurality of heat transfer plates, in which an inflow opening for a refrigerant is provided in a central portion in a widthwise direction of the heat transfer plates to prevent deflected flow of fluid in a flow path between the plates, is known and has been disclosed, for example, in JP-A-2000-292079 specification. Also, a plate-type heat exchanger in which vertical orifices communicating with flow paths between plates are provided at the inflow opening portion to promote turbulent flow of refrigerant flowing in the flow paths to uniformize the refrigerant has been disclosed, for example, in JP-A-2001-50611 specification.

In the above-described prior arts, it is difficult to improve both prevention of the deflected flow of the fluid in the flow path between the plates and uniform distribution of the fluid among the flow paths. Also, when the laminated heat exchanger is used as an evaporator or a condenser, distribution performance of water and refrigerant must be made especially high to promote downsizing and improvement in performance of the heat exchanger or to avoid a danger of freezing. Further, if the plates are fixed completely to each other by brazing to enhance the pressure resistance of a refrigerant-side flow path, the plates cannot be detached, so that dirt adhered to the plate surface of a water-side flow path cannot be removed.

Also, in the plate-type heat exchanger, in the ordinary service condition, since the fluid flows vigorously in a narrow and flat flow path, a pressure loss is generally high. For example, in a chiller unit, the pressure loss in the water-side flow path must be kept at a certain value or lower in connection with a water pump. However, the pressure loss in the water-side flow path being made too small leads to an increase in size of the heat exchanger.

An object of the present invention is to solve the above problems and to provide a laminated heat exchanger and a refrigeration cycle which are suitable for a high-pressure refrigerant also, the size thereof are small, the pressure loss are low, the degree of freedom of design is high, the heat exchanger is capable of being disassembled, the distribution of water and refrigerant is good, and the refrigerant does not leak. Also, another object thereof is to enable dirt adhered to the plate surface of a water-side flow path to be removed easily from the viewpoint of energy saving of refrigeration cycle.

SUMMARY OF THE INVENTION

To attain the above objects, the present invention provides a laminated heat exchanger including a plurality of laminated plates, in which a plurality of heat transfer tubes bent into a zigzag form are arranged in contact with each surface of each of the plates, and the plates are laminated so that the heat transfer tubes on one of adjacent plates intersect with the heat transfer tubes on the other of the adjacent plates.

Also, it is preferable that headers should be provided to bundle the heat transfer tubes for each plate, and collecting headers should be provided to bundle the headers.

Further, it is preferable that there should be provided headers for bundling the heat transfer tubes for each plate; collecting headers for bundling the headers; refrigerant pipes respectively connected to the collecting headers; and a sealed casing having a water inlet and a water outlet and containing the plates, the headers, and the collecting headers.

Further, it is preferable that there should be provided headers for bundling the heat transfer tubes for each plate; collecting headers for bundling the headers; refrigerant pipes connected to the collecting headers; water scattering plates which are formed with holes; and a sealed casing having a water inlet and a water outlet and containing the plates, the headers, the collecting headers, and the water scattering plates, the water scattering plates being inclined slantwise with respect to the water inlet and the water outlet.

Further, it is preferable that there should be provided headers for bundling the heat transfer tubes for each plate; collecting headers for bundling the headers; refrigerant pipes connected to the collecting headers; and a casing having a water inlet and a water outlet, containing the plates, the headers, and the collecting headers, and provided with flanges in end portions thereof, the casing being sealed by fastening end face covers to the flanges.

Further, it is preferable that the heat transfer tubes should be bent into a sinusoidal wave form.

Further, it is preferable that the heat transfer tubes should be bent into an S-shape.

Further, the present invention provides a refrigeration cycle having a primary loop in which a primary refrigerant circulates through a compressor, an outdoor heat exchanger, an expansion valve, and an intermediate heat exchanger and a secondary loop in which a secondary refrigerant circulates through the intermediate heat exchanger, a pump, and an indoor heat exchanger, in which the intermediate heat exchanger has a plurality of plates and a plurality of heat transfer tubes which are bent into a zigzag form and are arranged in contact with each surface of each plate, the plates being laminated so that the heat transfer tubes in contact with one surface of each plate intersect with the heat transfer tubes in contact with the other surface of each plate.

Further, it is preferable that a natural refrigerant should be used as the primary refrigerant, and water should be used as the secondary refrigerant.

Other objects, features and advantages of the invention will become apparent from the following description of the embodiments of the invention taken in conjunction with the accompanying drawings.

PREFERRED EMBODIMENT OF THE INVENTION

Figure 1:
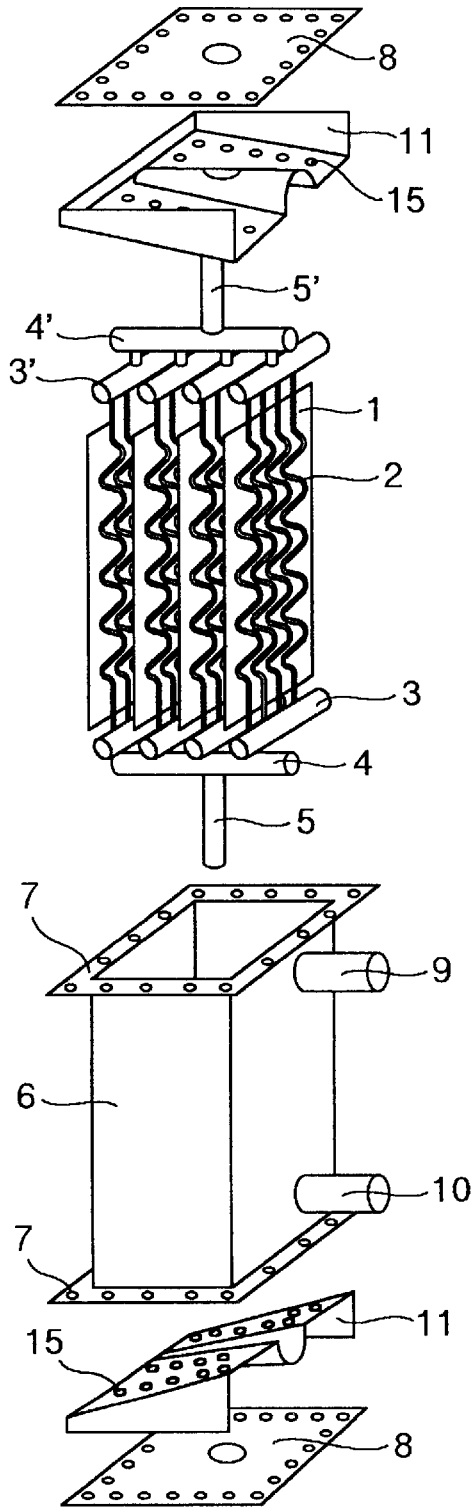
FIG. 1 is an exploded perspective view of a first embodiment of a laminated heat exchanger in accordance with the present invention.

A first embodiment of a laminated heat exchanger of the present invention will be described with reference to FIGS. 1 to 4.

FIGS. 1 to 4 show a laminated heat exchanger, which is formed by laminating a plurality of plates 1 made of a thin metal sheet, in contact with the surface of which pipe-like heat transfer tubes 2, 2' bent into a sinusoidal wave form or a zigzag form are arranged. A refrigerant flows in the heat transfer tube 2, and water flows on the outside thereof. The heat transfer tubes 2, 2' are bundled together by headers 3, 3' located above and below the tubes, and the headers 3, 3' are bundled together by upper and lower collecting headers 4, 4'. Further, above and below the collecting headers 4, 4', there are provided refrigerant pipes 5, 5'. The plates 1, which serve as a principal portion of heat exchange, are inserted in a casing 6 having a water inlet 9 and a water outlet 10, together with water scattering plates 11. The casing 6 is fastened to end face covers 8 by means of flanges 7 using screws, rivets, or the like.

Figure 2:
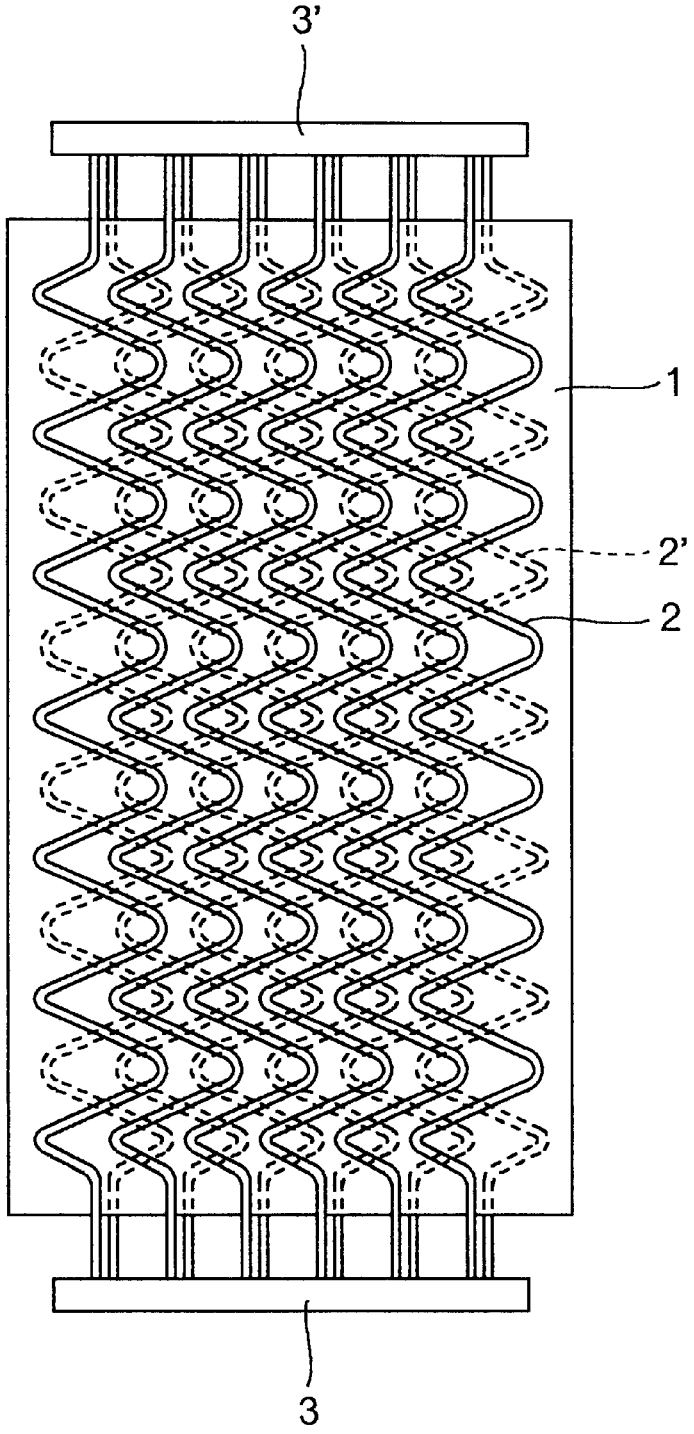
FIG. 2 is a plan view showing a state in which plates of the first embodiment shown in FIG. 1 are laminated.
Figure 3:
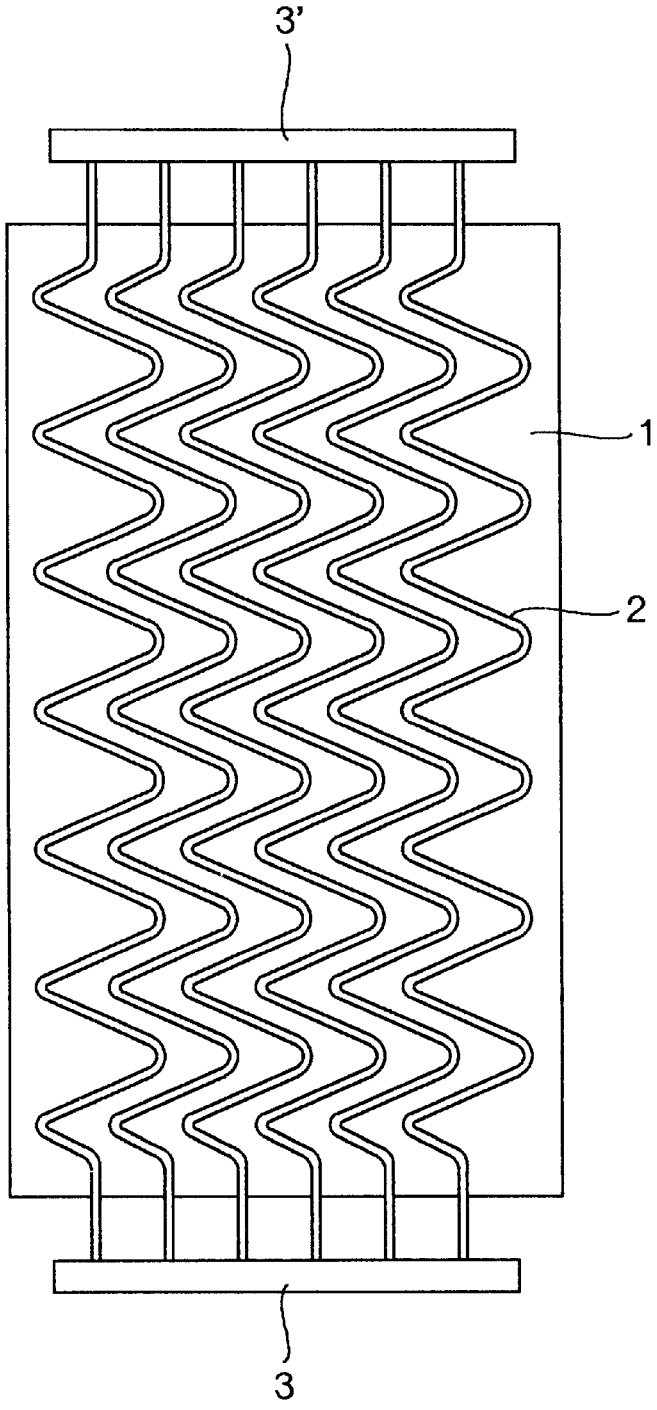
FIG. 3 is a plan view of the plate shown in FIG. 2.
Figure 4:
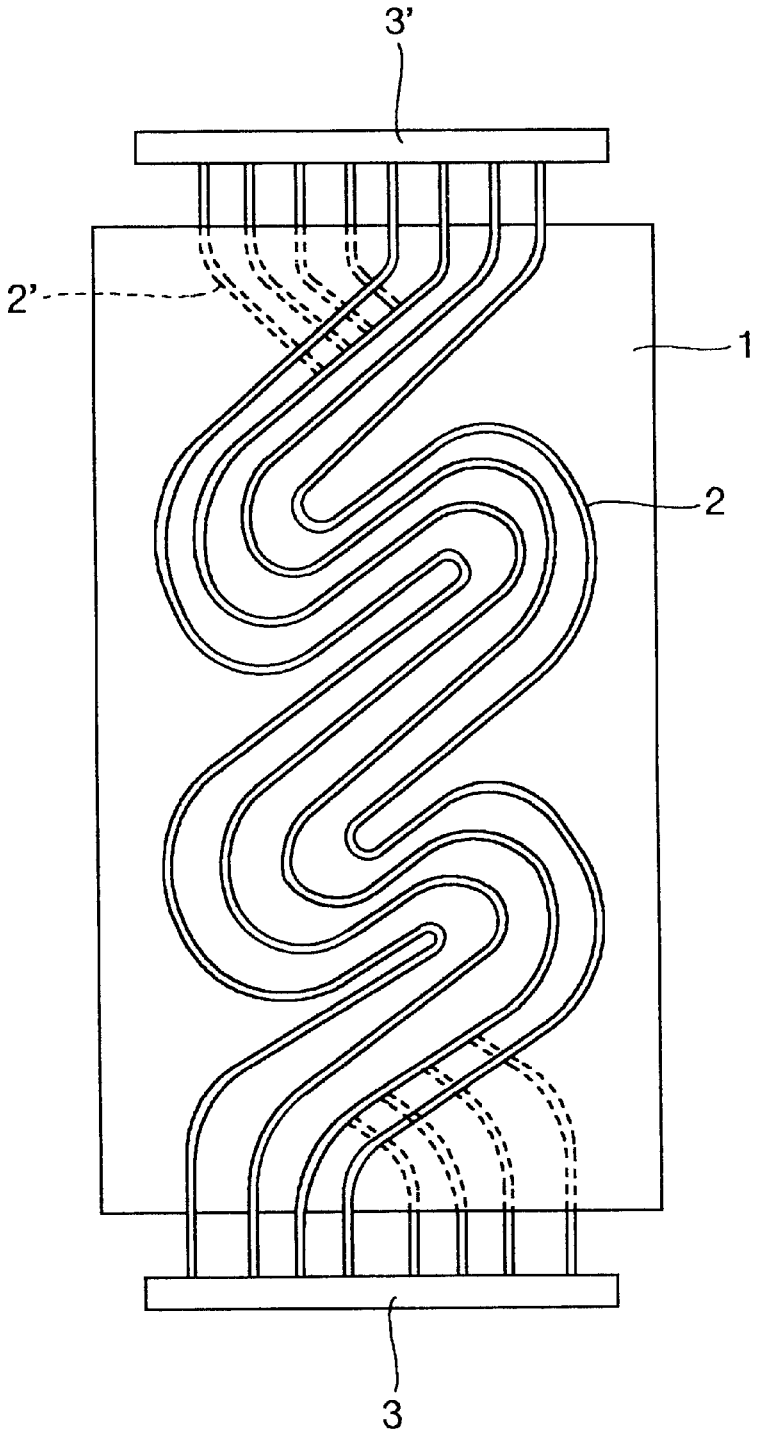
FIG. 4 is a plan view of a plate in accordance with a second embodiment of a laminated heat exchanger in accordance with the present invention.

Examples of bending and arranging patterns of the heat transfer tubes 2, 2' are as shown in FIGS. 2 to 4. In an example shown in FIG. 2, the heat transfer tubes 2, 2' bent into a sinusoidal wave form or a zigzag form are arranged in contact with both surfaces of the plate 1. FIG. 3 shows that the heat transfer tubes 2, 2' bent into a sinusoidal wave form or a zigzag form are arranged in contact with only one surface of the plate 1. In an example shown in FIG. 4, the heat transfer tubes 2, 2' bent into an S-shaped continuous zigzag form are arranged in contact with both surfaces of the plate 1.

In the plates 1 shown in FIGS. 2 and 4, a pattern similar to the herringbone type plate is formed in the state when the plates 1 are laminated. In the plates 1 shown in FIG. 3, a zigzag-form flow path pattern is formed between the plates 1 when the plates are laminated. In the present embodiment, since the refrigerant flows in the heat transfer tubes 2, 2' of a pipe form (cylindrical or tubular form), high strength of pressure resistance can be maintained, and hence there is no fear of refrigerant leakage as long as the tube is not broken. Therefore, in spite of being of a laminated type, this heat exchanger is also suitable for the refrigeration cycle using a high-pressure refrigerant such as R410A and carbon dioxide.

A water-side flow path is formed between the laminated plates 1. Water flows into the casing 6 through the water inlet 9 provided thereon and, after flowing between the plates 1, flows out through the water outlet 10. Although the water-side flow path is sealed by the flanges 7, the pressure thereof is considerably lower than the pressure on the refrigerant side, and even if water leaks, the influence of leakage is far less than that on the refrigerant side. Also, even if the evaporation temperature of the refrigeration cycle decreases and thus ice is formed on external surfaces of the heat transfer tubes 2, 2' to be a frozen state, since a sufficient space is formed around the heat transfer tubes 2, 2', the blockage of the whole flow path is not happened.

When the present embodiment of the laminated heat exchanger is used as a water-refrigerant heat exchanger for a chiller unit, a complete counterflow should be formed as described below from the viewpoints of the heat exchange performance and influence of gravity. In the case where the heat exchanger is used as an evaporator, the refrigerant is caused to flow in through the lower header 3, and to flow through the heat transfer tubes 2, 2', and then to flow out through the upper header 3'. On the other hand, water is caused to flow in through the water inlet 9 on the upper side, and to flow between the plates 1, and then to flow out through the water outlet 10 on the lower side. Contrarily, in the case where the heat exchanger is used as a condenser, the refrigerant is caused to flow in through the upper header 3', to flow through the heat transfer tubes 2, 2', and then to flow out through the lower header 3. On the other hand, water is caused to flow in from the lower side, to flow between the plates 1, and then to flow out from the upper side. The complete counterflow is especially effective in improving the efficiency of refrigeration cycle in the case where a nonazeotropic mixture refrigerant such as R407C is used.

Also, on the refrigerant side, by performing micromachining such as micro-fins in the heat transfer tube 2, 2', a high in-tube heat transfer rate can be obtained. On the water-side, when water flows between the plates 1, three-dimensional turbulence occurs, by which a greater heat transfer promotion effect can be achieved. Further, the three-dimensional turbulence can prevent scale from adhering on the surface of the plate 1.

With this structure, excellent heat transfer characteristics are obtained between refrigerant and water, and also the size of heat exchanger can be decreased significantly as compared with the shell-and-tube heat exchanger or the like. Also, since the pressure loss on the water-side is low, the heat exchanger can be made small-sized and compact. Further, since the width of water-side flow path can be made greater than that of the plate-type heat exchanger of a herringbone type, the pressure loss on the water-side can be made as low as 1/10 or less of that of the plate-type heat exchanger of a herringbone type. In the case of the heat exchanger for a chiller unit, therefore, the power of the pump for water can be reduced, and the heat exchanger can be made small in size. Further, the pressure loss of refrigerant flowing in the heat transfer tubes also becomes equivalent to that of the ordinary finned tube type heat exchanger for a room air conditioner.

By making the flange 7 detachable, the plates 1, which are a principal portion of heat exchange, can be taken out. Therefore, even if scale adheres on the surfaces of the plates 1, it can be removed easily. If dirt adhered on the plate surface on the water-side flow path is removed periodically, the performance can be recovered, so that energy saving of refrigeration cycle can be achieved.

The surfaces of the water scattering plates 11 on header-side are inclined slantwise with respect to the water inlet 9 and the water outlet 10, and the surfaces are provided with many holes 15. Thereby, the water flow distribution during the time when water flows between the plates 1 can be made good. Also, the refrigerant coming from the refrigerant pipe 5 passes through a two-stage distribution portion of the collecting header 4 and the header 3, by which the distribution performance is improved.

Figure 5:
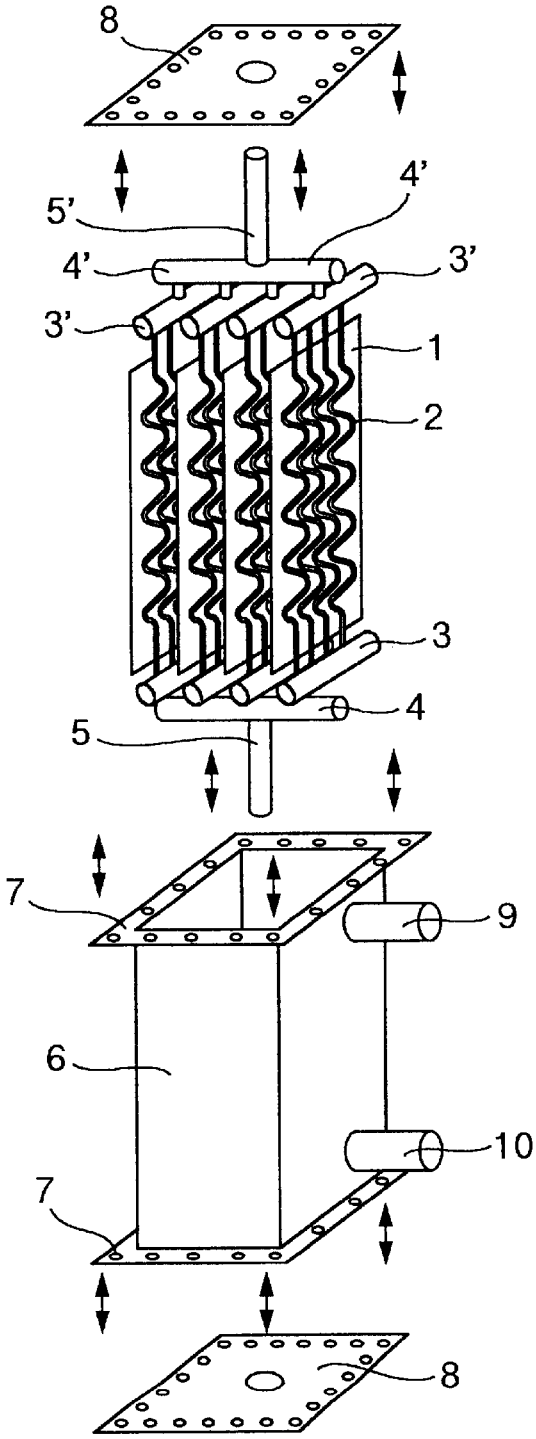
FIG. 5 is an exploded perspective view of a laminated heat exchanger in accordance with another embodiment of the present invention.
Figure 6:
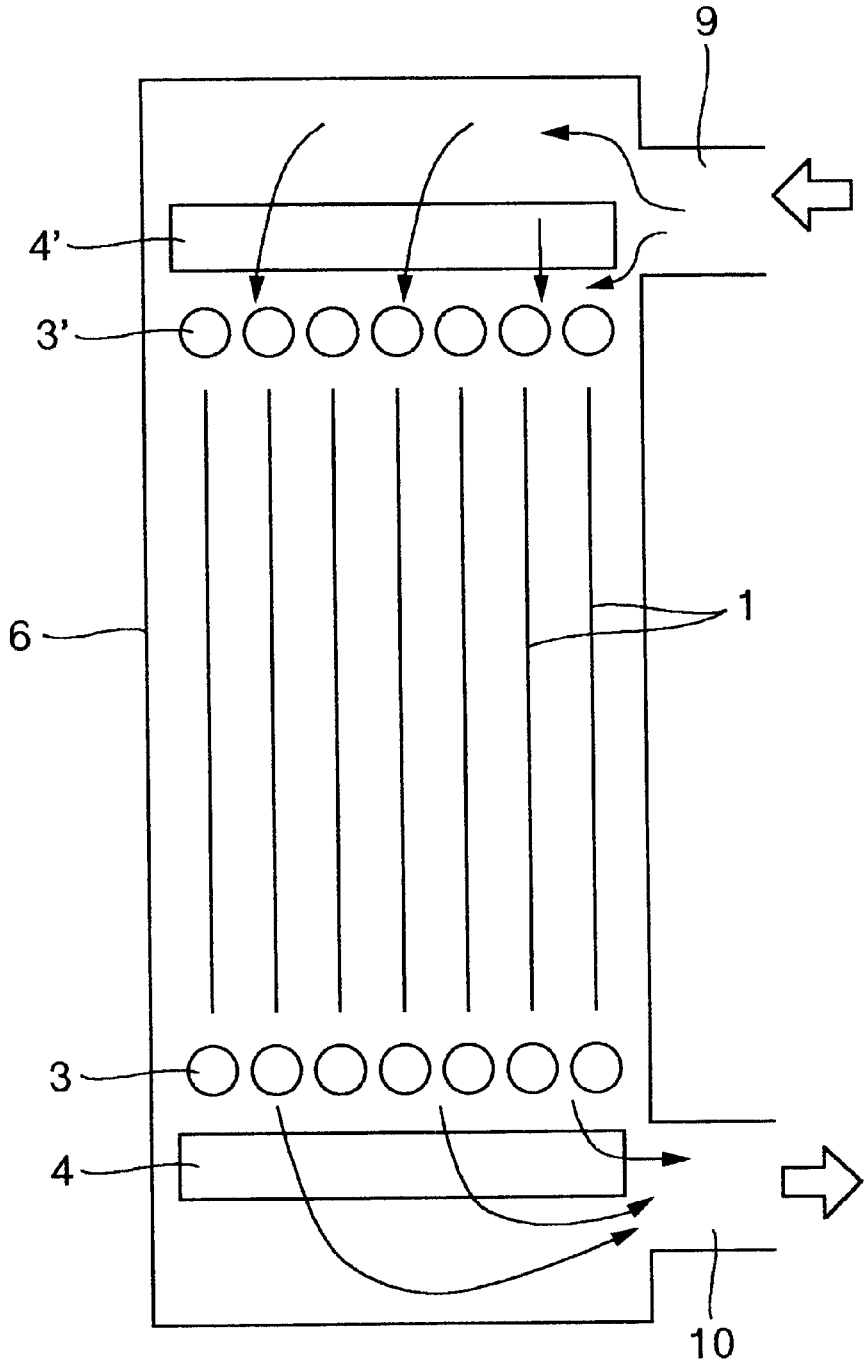
FIG. 6 is a sectional view showing a flow in a casing of the second embodiment shown in FIG. 5.

FIG. 5 shows a second embodiment of a laminated heat exchanger of the present invention, in which the water scattering plates 11 are omitted as compared with the first embodiment shown in FIG. 1. As shown in FIG. 6, the water flow coming from the water inlet 9 collides with the collecting header 4' and is scattered once in all directions, and thereafter, is throttled by the headers 3'. This provides a proper resistance for scattering water, and the distribution of water flow coming from the water inlet 9 is kept proper, which offers an advantage that the constructions of water inlet and outlet portions can be simplified.

Figure 7:
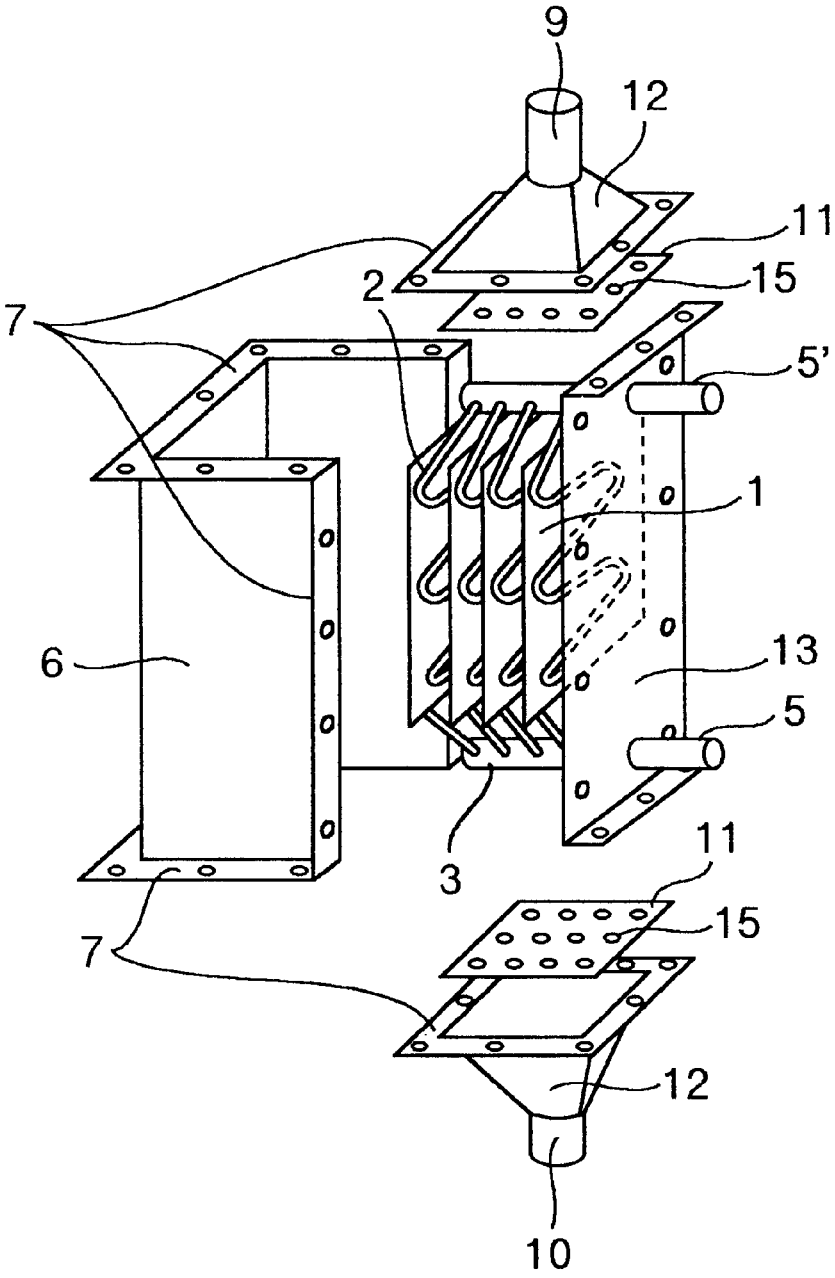
FIG. 7 is an exploded perspective view of a third embodiment of a laminated heat exchanger in accordance with the present invention.
Figure 8:
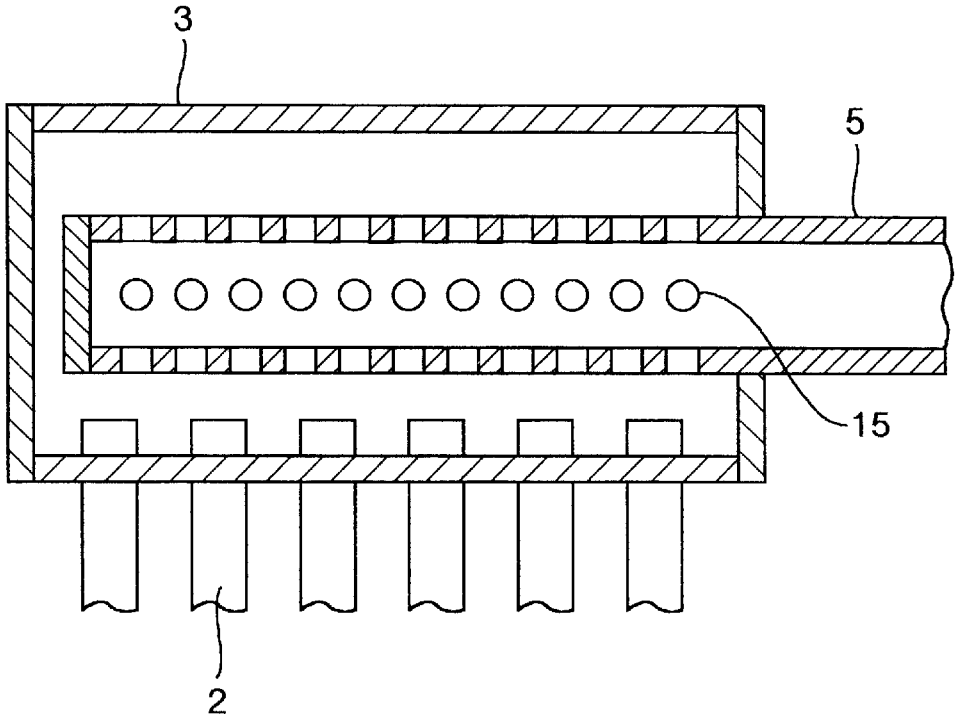
FIG. 8 is a sectional view showing the details of a header portion of the third embodiment shown in FIG. 7.

FIG. 7 shows a third embodiment of a laminated heat exchanger of the present invention, in which the casing 6 has only three sides, and the remaining one side is a side cover 13 provided adjacently to the plates 1. Root portions of the water inlet 9 and the water outlet 10 are made into diffusers 12, and on the inside thereof are provided the water scattering plates 11 consisting of a flat plate formed with many holes 15. The header 3 for bundling the heat transfer tubes 2 is connected with the refrigerant pipe 5 at the side thereof, the details of which are shown in FIG. 8. The header 3 has a double construction, that is, the header 3 is constructed so that an end portion of the refrigerant pipe 5 is closed, many holes 15 are formed in the vicinity of the end portion, and the portion formed with the holes 15 is inserted in the header 3 for bundling the heat transfer tubes 2. The refrigerant coming from the refrigerant pipe 5 flows into the header 3 uniformly through the holes 15. After the refrigerant is uniformized in the refrigerant header 3, the refrigerant flows into each of the heat transfer tubes 2. Thereby, the refrigerant flowing into the heat transfer tubes 2 is distributed between the plates 1 further properly. Also, by the use of the diffuser 12 and the water scattering plate 11, the distribution of water flow between the plates 1 is made good, so that the heat exchanger is made compact and also freezing is prevented.

Figure 9:
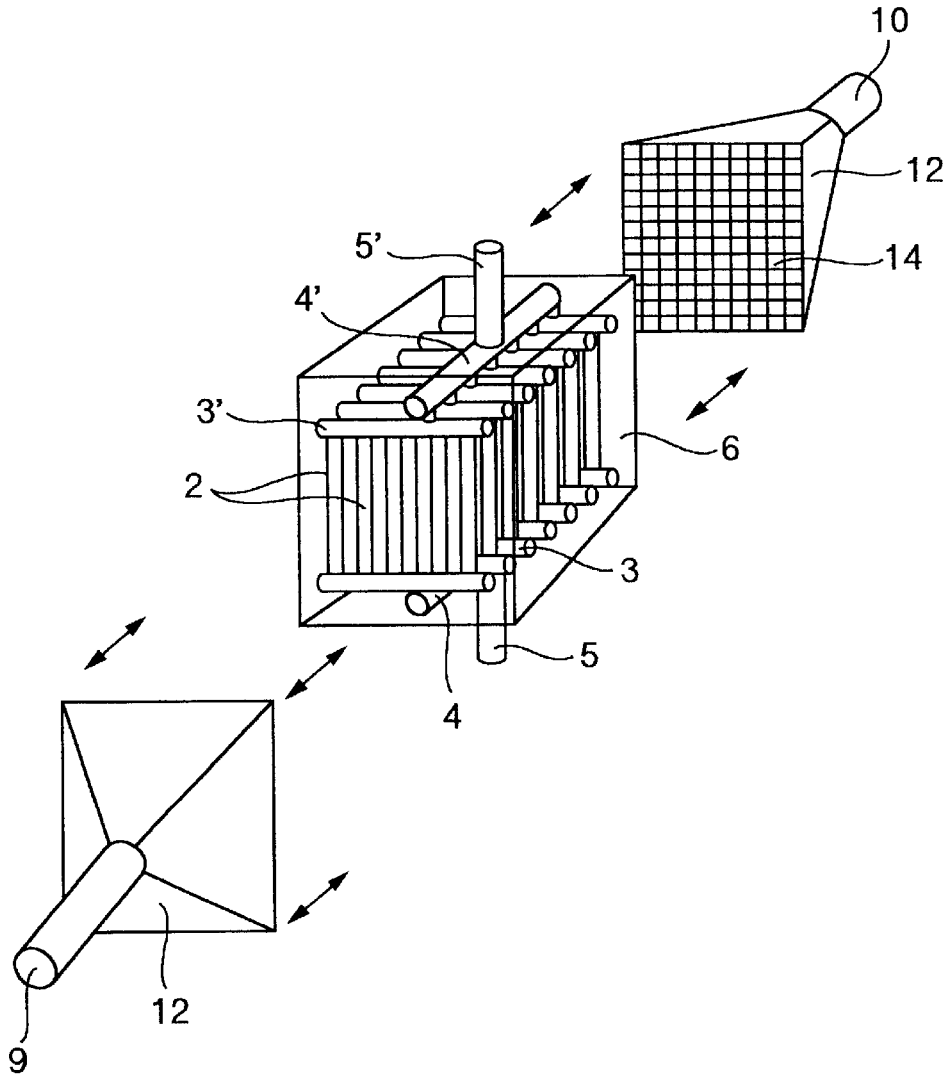
FIG. 9 is an exploded perspective view of a fourth embodiment of a laminated heat exchanger in accordance with the present invention.
Figure 11:
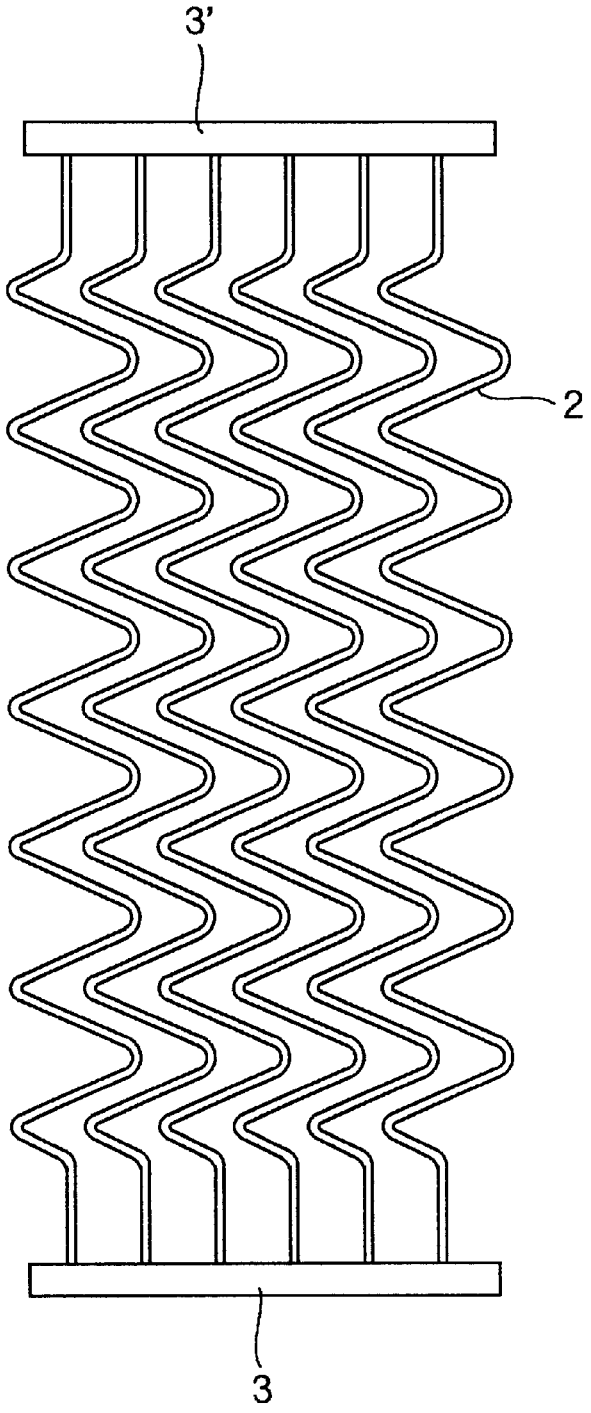
FIG. 11 is a plan view showing a group of the heat transfer tubes used in the fourth and fifth embodiments shown in FIGS. 9 and 10.

FIG. 9 shows a fourth embodiment of a laminated heat exchanger of the present invention, in which a tube group is formed by bundling a plurality of unit groups, in which many straight heat transfer tubes 2 are arranged in parallel between the headers 3, 3', by using the collecting header 4, 4'. The tube group is put in the casing 6 whose two sides are open. The open two sides each are connected to the diffuser 12 having a mesh 14, and the diffusers 12 are connected to the water inlet 9 and the water outlet 10. This configuration is effective in terms of manufacture in the case where the heat transfer tube 2 has a small diameter. Also, if the heat transfer tubes 2 are bundled together by the collecting header 4, 4' so that units bent as shown in FIG. 11 are reversed for each unit, the water flowing on the outside of the heat transfer tubes 2 forms a complicated flow with turbulence, so that the heat transfer on the water-side is promoted.

Figure 10:
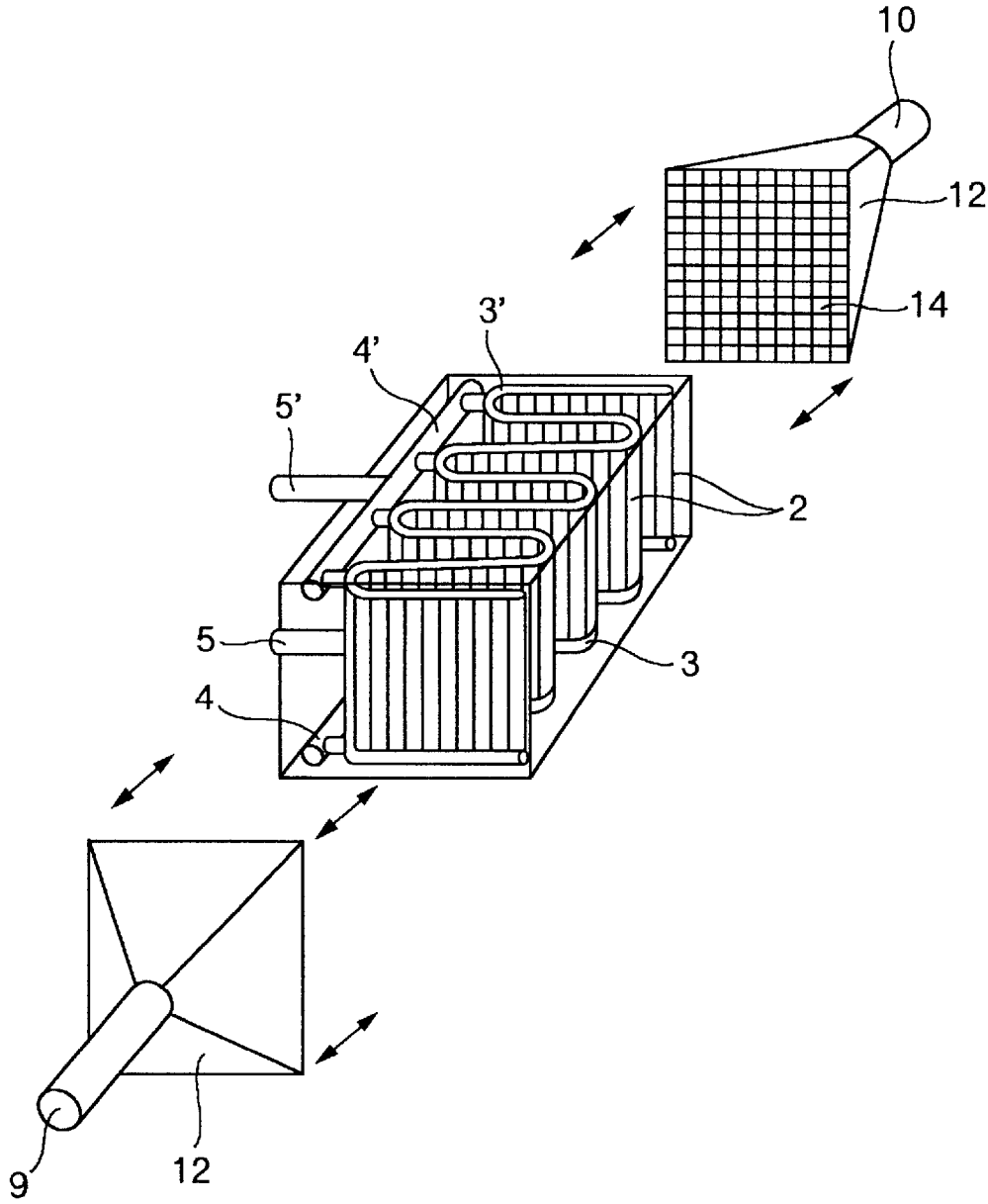
FIG. 10 is an exploded perspective view of a fifth embodiment of a laminated heat exchanger in accordance with the present invention.

FIG. 10 shows a fifth embodiment of a laminated heat exchanger of the present invention. Many straight and small-diameter heat transfer tubes 2 are arranged between the headers 3, 3'. The headers 3, 3' are bent into a zigzag form. The collecting headers 4, 4' are connected to the side of the headers 3, 3'. The refrigerant pipes are connected to the opposite side of the headers 3, 3'. In this embodiment, the connection of tube group is easier as compared with the heat exchanger shown in FIG. 9. Also, the heat exchanger is effective even in the case where the fluid flowing on the outside of the heat transfer tube 2 is a gas such as air. Further, since the performance of the pressure resistance on the inside of the heat transfer tubes 2 is high, a high-pressure natural refrigerant such as carbon dioxide can be used easily.

Figure 12:
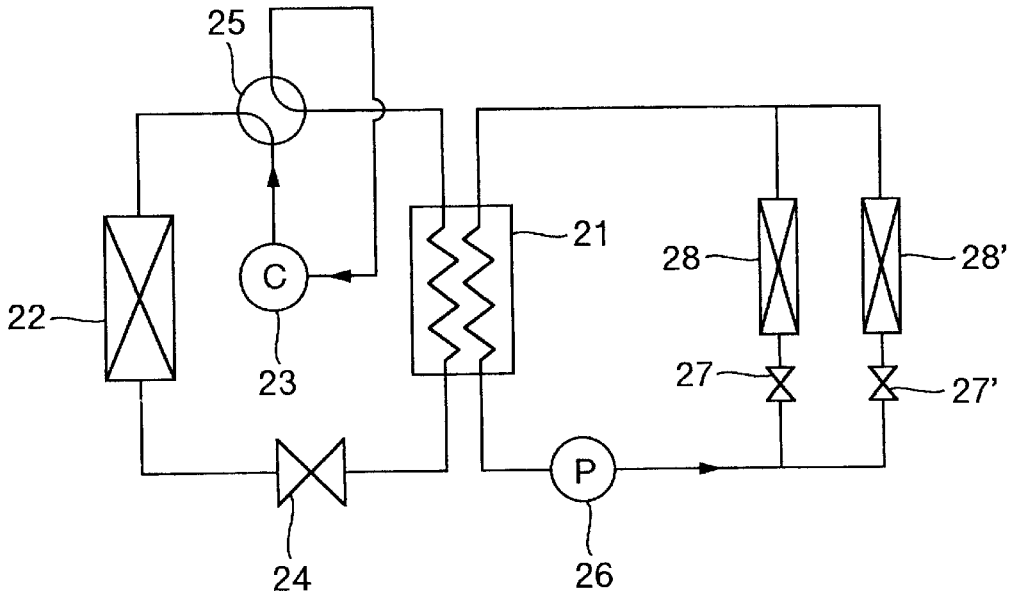
FIG. 12 is a block diagram showing a refrigeration cycle using one embodiment of a laminated heat exchanger in accordance with the present invention.

FIG. 12 shows a refrigeration cycle using a laminated heat exchanger in accordance with the above-described embodiments. This refrigeration cycle is formed by a primary loop in which a refrigerant circulates and a secondary loop in which water (or brine) circulates. In the primary loop are provided an intermediate heat exchanger 21, a compressor 23, a four-way valve 25, an outdoor heat exchanger 22, an expansion valve 24, etc., and in the secondary loop are provided a flow regulating valve 27 and an indoor heat exchanger 28. The primary loop side is driven by the compressor 23, and an already described laminated heat exchanger is used as the intermediate heat exchanger 21 or the outdoor heat exchanger 22. The secondary loop side has an indoor unit comprising the flow regulating valve 27, the indoor heat exchanger 28, etc., and is driven by a pump 26.

When a room is cooled, a high-temperature and high-pressure refrigerant gas coming from the compressor 23 is cooled and condensed by the outdoor heat exchanger 22 to turn to a high-temperature refrigerant liquid. The refrigerant liquid is adiabatically expanded by the expansion valve 24 to change into a low-temperature and low-pressure two-phase state, and is evaporated by heat absorption in the intermediate heat exchanger 21 and turns to a low-temperature and low-pressure refrigerant gas. Thereafter, the refrigerant gas returns to the compressor 23. On the other hand, water (or brine) in the intermediate heat exchanger 21 is cooled by the evaporation of refrigerant, and is introduced into the indoor unit by being driven by the pump 26. Thereafter, heat exchange is effected in the indoor heat exchanger 28, by which the air on the inside of room is cooled. In this refrigeration cycle, the quantity of refrigerant used can be decreased, and the refrigeration cycle can be made compact. Also, the refrigerant is prevented from entering the indoor space by the use of the laminated heat exchanger. Therefore, there can be prevented a danger incurred when a natural refrigerant, which may be combustible or toxic, such as HC refrigerant and ammonia is used. Further, since the heat exchanger has a high pressure resisting strength, the refrigeration cycle can be operated by a high pressure of about 10 MPa on the high pressure side and about 5 MPa on the low pressure side as in the case of carbon dioxide.

According to the present invention, there can be provided a laminated heat exchanger suitable for a high-pressure refrigerant, in which the size thereof is small, the pressure loss is low, the degree of freedom of design is high, the heat exchanger being capable of being disassembled, the distribution of water and refrigerant is good, no refrigerant leaking, and a refrigeration cycle using the above-described heat exchanger.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A laminated heat exchanger comprising a plurality of laminated plates, in which a plurality of heat transfer tubes bent into a zigzag form are arranged in contact with each surface of each of said plates, and said plates are laminated so that the heat transfer tubes on one of adjacent plates intersect with the heat transfer tubes on the other of the adjacent plates.

2. A laminate d heat exchanger according to claim 1, further comprising headers provided to bundle said plurality of heat transfer tubes for each plate, and collecting headers provided to bundle said headers.

3. A laminated heat exchanger according to claim 1, further comprising headers for bundling said heat transfer tubes for each plate; collecting headers for bundling said headers; refrigerant pipes respectively connected to said collecting headers; and a sealed casing having a water inlet and a water outlet and containing said plates, said headers, and said collecting headers.

4. A laminated heat exchanger according to claim 1, further comprising headers for bundling said plurality of heat transfer tubes for each plate; collecting headers for bundling said headers; refrigerant pipes respectively connected to said collecting headers; and a sealed casing having a water inlet and a water outlet and containing said plates, said headers, said collecting headers, and water scattering plates which are inclined slantwise with respect to said water inlet and said water outlet and are formed with holes in the surfaces therein.

5. A laminated heat exchanger according to claim 1, further comprising headers for bundling said plurality of heat transfer tubes for each plate; collecting headers for bundling said headers; refrigerant pipes respectively connected to said collecting headers; and a casing having a water inlet and a water outlet, containing said plates, said headers, and said collecting headers, and provided with flanges in the end portions, said casing being sealed by fastening end face covers to said flanges.

6. A laminated heat exchanger according to claim 1, wherein said plurality of heat transfer tubes are bent into a sinusoidal wave form.

7. A laminated heat exchanger according to claim 1, wherein said plurality of heat transfer tubes are bent into an S-shape.

8. A refrigeration cycle having a primary loop in which a primary refrigerant circulates through a compressor, an outdoor heat exchanger, an expansion valve, and an intermediate heat exchanger and a secondary loop in which a secondary refrigerant circulates through said intermediate heat exchanger, a pump, and an indoor heat exchanger, wherein said intermediate heat exchanger has a plurality of plates and a plurality of heat transfer tubes which are bent into a zigzag form and are arranged in contact with each surface of each of said plates, said plates being laminated so that the heat transfer tubes on one of adjacent plates intersect with the heat transfer tubes on one of the adjacent plates.

9. The refrigeration cycle according to claim 8, wherein a natural refrigerant is used as said primary refrigerant, and water is used as said secondary refrigerant.

10. A laminated heat exchanger comprising a plurality of laminated plates, in which a plurality of heat transfer tubes bent into a zigzag form are arranged in contact with each surface of each of said plates, and said plates are laminated so that the heat transfer tubes in contact with one surface of each of the plates intersect with the heat transfer tubes in contact with the other surface of each of the plates.

11. A laminated heat exchanger according to claim 10, further comprising headers provided to bundle said plurality of heat transfer tubes for each plate, and collecting headers provided to bundle said headers.

12. A laminated heat exchanger according to claim 10, further comprising headers for bundling said heat transfer tubes for each plate; collecting headers for bundling said headers; refrigerant pipes respectively connected to said collecting headers; and a sealed casing having a water inlet and a water outlet and containing said plates, said headers, and said collecting headers.

13. A laminated heat exchanger according to claim 10, further comprising headers for bundling said plurality of heat transfer tubes for each plate; collecting headers for bundling said headers; refrigerant pipes respectively connected to said collecting headers; and a sealed casing having a water inlet and a water outlet and containing said plates, said headers, said collecting headers, and water scattering plates which are inclined slantwise with respect to said water inlet and said water outlet and are formed with holes in the surfaces therein.

14. A laminated heat exchanger according to claim 10, further comprising headers for bundling said plurality of heat transfer tubes for each plate; collecting headers for bundling said headers; refrigerant pipes respectively connected to said collecting headers; and a casing having a water inlet and a water outlet, containing said plates, said headers, and said collecting headers, and provided with flanges in the end portions, said casing being sealed by fastening end face covers to said flanges.

15. A laminated heat exchanger according to claim 10, wherein said plurality of heat transfer tubes are bent into a sinusoidal wave form.

16. A laminated heat exchanger according to claim 10, wherein said plurality of heat transfer tubes are bent into an S-shape.

* * * * *